US005363837A

United States Patent [19]

Jang

[11] Patent Number: 5,363,837

[45] Date of Patent: Nov. 15, 1994

[54] OUTER HOUSING OF KITCHEN SMOKE EXHAUSTER

[76] Inventor: Sun-Sing Jang, 650, Yuan-Huan E. Rd., Fong-Yuan, Taichung, Taiwan, Prov. of China

[21] Appl. No.: 208,297

[22] Filed: Mar. 10, 1994

[51] Int. Cl.[5] ..... F24C 15/20

[52] U.S. Cl. ..... 126/299 D; 126/299 R; 285/424

[58] Field of Search ..... 126/299 D, 299 R; 220/677, 678, 679, 680; 403/335, 336, 383; 285/424; 29/521

[56] References Cited

U.S. PATENT DOCUMENTS

| | | | |
|---|---|---|---|
| 1,465,652 | 8/1923 | Moore | 126/299 D X |
| 1,791,255 | 2/1931 | Wagner | 285/424 |
| 1,992,312 | 2/1935 | Kuehn | 285/424 |
| 2,901,963 | 9/1959 | Richardon, Jr. | 126/299 D |
| 3,098,423 | 7/1963 | Giannini | 126/299 D |
| 3,194,146 | 7/1965 | Jenson | 126/299 D |
| 4,441,241 | 4/1984 | Hoeffken | 29/157.3 R |
| 5,104,159 | 4/1992 | Sugiyama et al. | 285/424 |
| 5,176,125 | 1/1993 | Jang | 126/299 D |
| 5,267,550 | 12/1993 | Jang | 126/299 D |
| 5,305,734 | 4/1994 | Jang | 126/299 D X |

*Primary Examiner*—Larry Jones
*Attorney, Agent, or Firm*—Browdy and Neimark

[57] ABSTRACT

An outer housing of a kitchen smoke exhauster comprises a left-right side plate, a top plate and a plurality of U-shaped members. The left-right side plate has a main plate portion provided with a horizontal plate portion extending inwardly from the top edge thereof and having a first vertical strip portion extending downwards from the fringe thereof. The top plate has a base plate portion provided respectively at the left side thereof and the right side thereof with a second vertical strip portion extending downwards. Each of the U-shaped members has a middle plate portion provided respectively at the left side thereof and the right side thereof with a first wall plate portion and a second wall plate portion, which extend upwards such that they are curved and that they are corresponding to each other. The U-shaped members are so disposed that the first and the second vertical strip portions are received in the slots of the U-shaped members with an appropriate tightness. The second wall plate portion, the second vertical strip portion, the first vertical strip portion and the first wall plate portion are then punched with a punching tool.

8 Claims, 5 Drawing Sheets

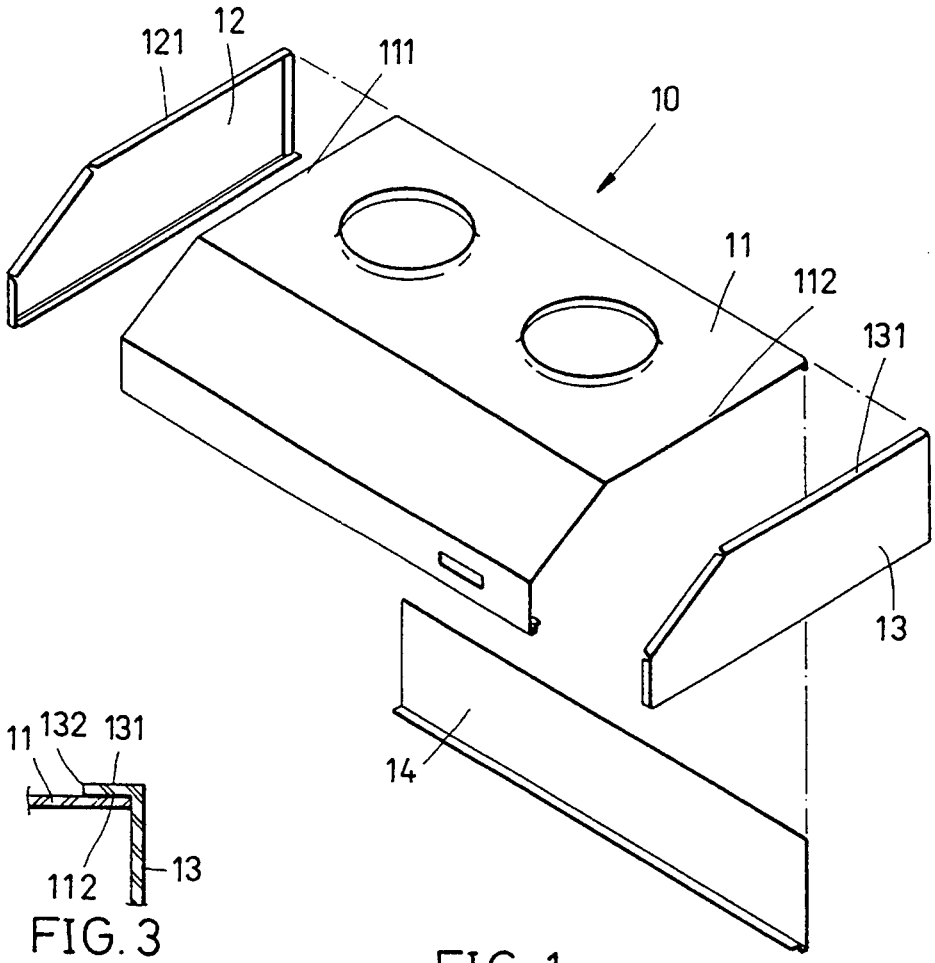
FIG. 1
(PRIOR ART)
FIG. 3
(PRIOR ART)
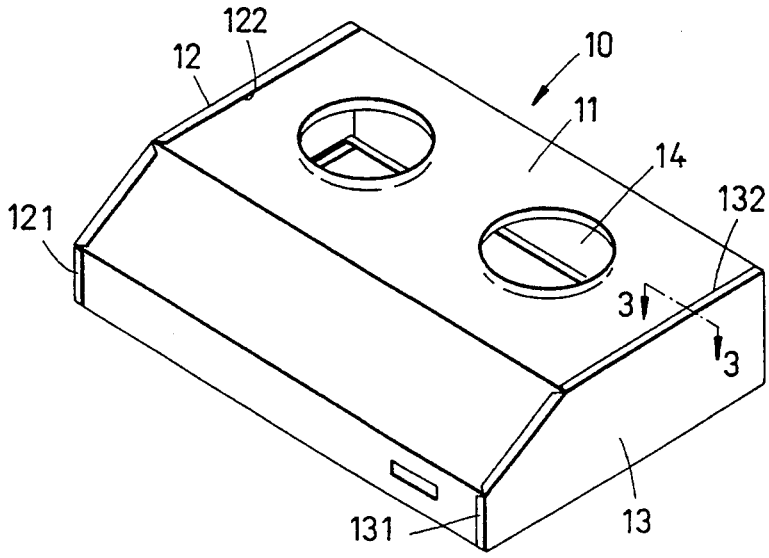
FIG. 2
(PRIOR ART)

OUTER HOUSING OF KITCHEN SMOKE EXHAUSTER

BACKGROUND OF THE INVENTION

The present invention relates generally to a kitchen smoke exhauster, and more particularly to the outer housing of a kitchen smoke exhauster.

As shown in FIGS. 1–3, an outer housing 10 of a prior art kitchen smoke exhauster is made up of a top plate 11, a left plate 12 a right plate 13 and a back plate 14. The left plate 12 and the right plate 13 are provided respectively with narrow strip portions 121 and 131 extending inwards and vertically from the fringes thereof. The narrow strip portions 121 and 131 are attached to the left and the right outer segments of the top of the plate 11 by spot welding.

The plates of the outer housing 10 described above are made of a stainless steel thin plate by punching and pressing. As a result, the narrow strip portions 121 and 131 have respectively sharp outer edges 122 and 132, which are potentially safety hazards to the workers assembling or handling the outer housing 10 or to the consumers installing the outer housing 10 by themselves.

SUMMARY OF THE INVENTION

It is therefore the primary objective of the present invention to provide a kitchen smoke exhauster with an outer housing devoid of any sharp edge on the outer surface thereof.

In keeping with the principle of the present invention, the foregoing objective of the present invention is attained by a kitchen smoke exhauster outer housing, which comprises a left-right side plate, a top plate and a plurality of U-shaped members. The left-right side plate has a main plate portion provided with a horizontal plate portion extending inwardly from the top edge thereof and having a first vertical strip portion extending downwards from the fringe thereof. The top plate has a base plate portion provided respectively at the left side thereof and the right side thereof with a second vertical strip portion extending downwards. Each of the U-shaped members has a middle plate portion provided respectively at the left side thereof and the right side thereof with a first wall plate portion and a second wall plate portion, which extend upwards in such a manner that they are curved and that they are corresponding to each other. The U-shaped members are so disposed that the first and the second vertical strip portions are received in the slots of the U-shaped members with an appropriate tightness. The second wall plate portion, the second vertical strip portion, the first vertical strip portion and the first wall plate portion are then punched with a punching tool.

The foregoing objective, structures, functions, and features of the present invention will be more readily understood upon a thoughtful deliberation of the following detailed description of the present invention in conjunction with the drawings provided herewith.

BRIEF DESCRIPTION OF THE DRAWINGS

FIG. 1 shows a schematic view of an outer housing of a kitchen smoke exhauster of the prior art;

FIG. 2 shows a perspective view of the outer housing in combination, according to the prior art as shown in FIG. 1;

FIG. 3 shows an enlarged sectional view of a portion taken along the line 3—3 as shown in FIG. 2;

DETAILED DESCRIPTION OF THE INVENTION

Figure 4:
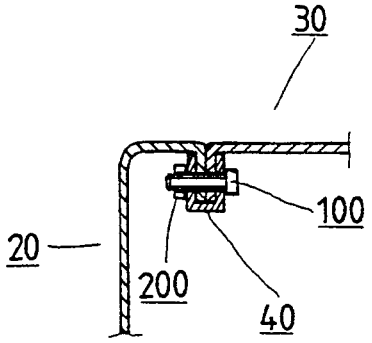
FIG. 4 shows a schematic view of a first preferred embodiment of the present invention.
Figure 6:
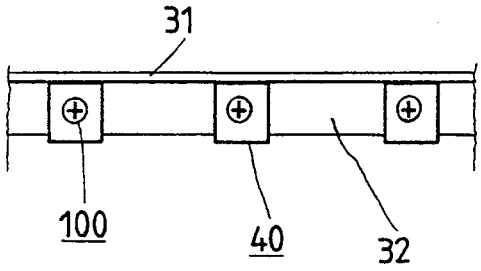
FIG. 6 shows a right elevational view of the first preferred embodiment of the present invention.
Figure 5:
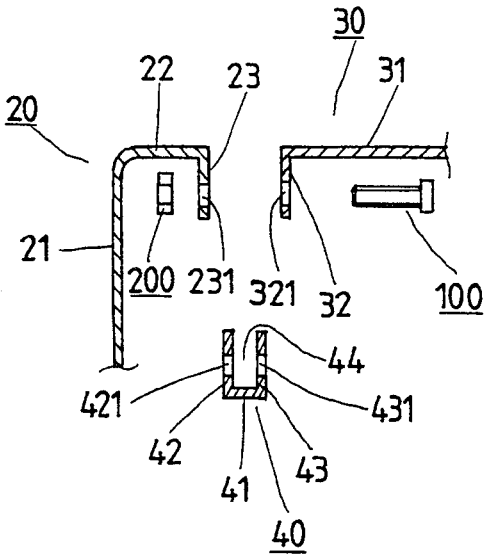
FIG. 5 shows an exploded view of the first preferred embodiment of the present invention.

As shown in FIGS. 4–7, the first preferred embodiment of the present invention comprises the component parts, which are described hereinafter.

A left-right side plate 20 has a main plate portion 21 provided with a horizontal plate portion 22 extending inwardly from the top edge thereof, and with a first upright strip portion 23 curving downwards from the side edge thereof. The first upright strip portion 23 is provided thereon at intervals with a plurality of first through holes 231.

A top plate 30 has a base plate portion 31 provided respectively at both left and right sides thereof with a second upright strip portion 32 extending downwards in a curved manner. The second upright strip portion 32 is provided with a plurality of second through holes 321 corresponding in location and number to the first through holes 231 of the first upright strip portion 23.

Each of a plurality of U-shaped members 40 has a middle plate portion 41, which is horizontally disposed and provided respectively at both left side and right side thereof with a first wall plate portion 42 and a second wall plate portion 43. The first wall plate portion 42 and the second wall plate portion 43 extend upwards in a curved and corresponding manner and are provided respectively with a first air hole 421 and a second air hole 431 which are respective corresponding in location to the first through hole 231 and the second through hole 321.

In combination, the first upright strip portion 23 of the side plate 20 is disposed side by side with the second upright strip portion 32 of the top plate 30 such that the first through hole 231 is aligned with the second through hole 321. Thereafter, the U-shaped member 40 is inserted in an upward direction such that the middle slot 44 of the U-shaped member 40 receives therein the first and the second upright strip portions 23 and 32. The first and the second air holes 421 and 431 are aligned respectively with the first and the second through holes 231 and 321. A fastening element 100 is put sequentially through the second air hole 431, the second through hole 321, the first through hole 231 and the first air hole 421. The fastening element 100 is fastened with a nut 200.

Figure 7:
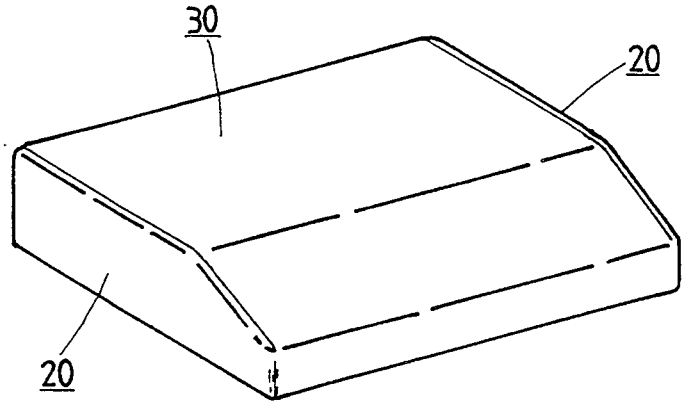
FIG. 7 shows a schematic view of a kitchen smoke exhauster of the present invention.

As shown in FIG. 7, the finished product of the present invention has an outer surface devoid of any sharp edge capable of inflicting an injury to a person.

Figure 8:
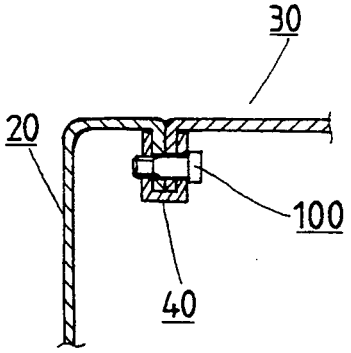
FIG. 8 shows a schematic view of a second preferred embodiment of the present invention.
Figure 9:
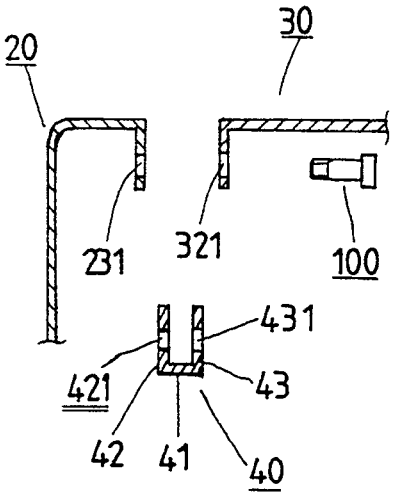
FIG. 9 shows an exploded view of the second preferred embodiment of the present invention.

As shown if FIGS. 8 and 9, the second preferred embodiment of the present invention is different from the first preferred embodiment of the present invention in that the former is provided with a U-shaped member 40 having a first wall plate portion 42 with a first air hole 421 which is constructed as a female threaded hole engageable with the tail end of the fastening element 100. As a result, the nut 200, which is included in the first preferred embodiment of the present invention, is not needed in the second preferred embodiment.

Figure 10:
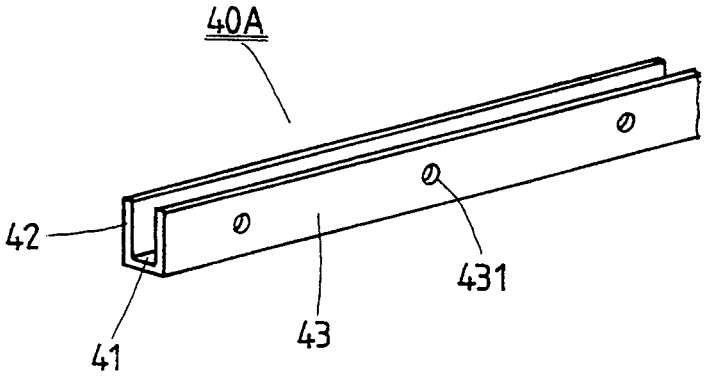
FIG. 10 shows a schematic view of a U-shaped member of a third preferred embodiment of the present invention.
Figure 11:
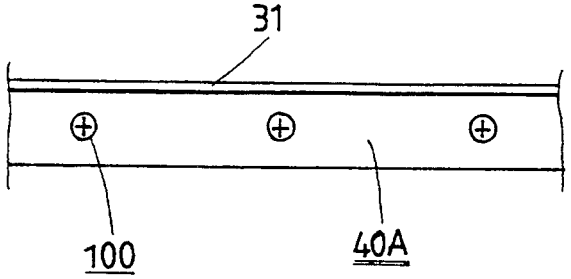
FIG. 11 is a right elevational view of the third preferred embodiment of the present invention, showing the way that the U-shaped member of the third preferred embodiment of the present invention is installed.
Figure 12:
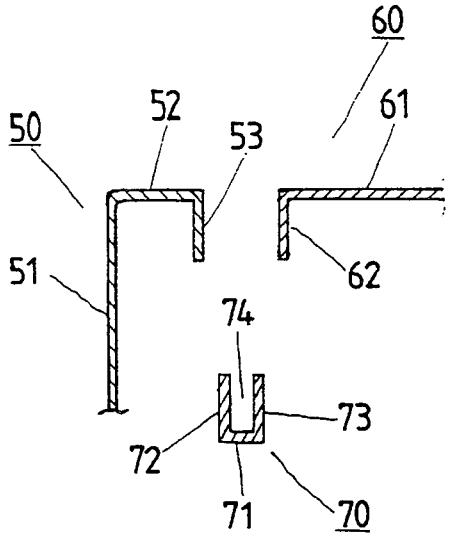
FIG. 12 shows an exploded view of a fourth preferred embodiment of the present invention.
Figure 13:
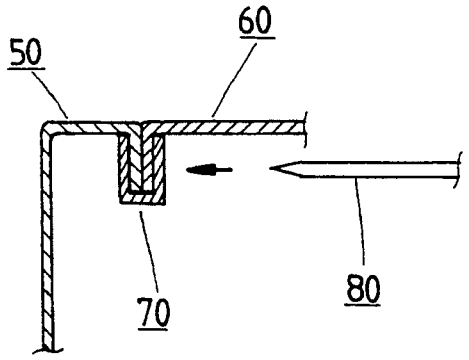
FIG. 13 shows a schematic veiw of the way that the fourth preferred embodiment of the present invention is installed.
Figure 14:
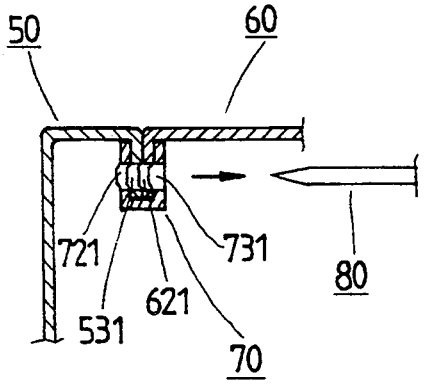
FIG. 14 shows a schematic view of the fourth preferred embodiment of the present invention upon completion of the assembly work.
Figure 15:
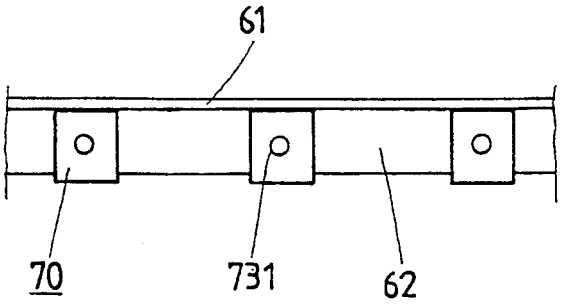
FIG. 15 shows a right elevation view of the fourth preferred embodiment of the present invention.

The third preferred embodiment of the present invetnion is shown in FIGS. 10 and 11, and is characterized in that its U-shaped member 40A is of a long striplike construction and provided with a first and a second wall plate portions 42 and 43, which are in turn provided respectively with a plurality of first air holes (not shown in the drawings) and second holes 431. In addition, the third preferred embodiment of the present invention is provided with a plurality of fastening elements 100, which are equal in number to the first and the second air holes. The fastening elements 100 are put through the first and the second air holes so as to fasten the first and the second upright strip portions 23 and 32.

As illustrated in FIGS. 12–15, the fourth preferred embodiment of the present invention comprises the component parts described hereinafter.

A left-right side plate 50 has a main plate portion 51 provided with a horizontal plate portion 52 extending inwardly from the top edge thereof, and with a first upright strip portion 53 curving downwards from the side edge thereof.

A top plate 60 has a base plate portion 61 provided respectively at both left and right sides thereof with a second upright strip portion 62 extending downwards in a curved manner.

Each of a plurality of U-shaped members 70 has a horizontally disposed middle plate portion 71 provided respectively at both left and right sides thereof with a first wall plate portion 72 and a second plate portion 73, which extend upwards in a curved and corresponding manner.

In combination, the first upright strip portion 53 of the side plate 50 is arranged side by side with the second upright strip portion 62 of the top plate 60. The U-shaped members 70 are then inserted upwardly such that the middle slot 74 of the U-shaped members 70 receives therein the first and the second upright strip portions 53 and 62 with an appropriate tightness. With a punching tool 80, and starting from the underside of the top plate 60, the second wall plate portion 73, the second upright strip portion 62, the first upright strip portion 53 and the first wall plate portion 72 are punched sequentially. In the punching process described above, a portion of the punched body of the second wall plate portion 73 can be carried into the punch hole 621 of the second upright strip portion 62. Similarly, a portion of the punched body of the second upright strip portion 62 is carried into the punch hole 531 of the first upright strip portion 53. A portion of the punched body of the first upright strip portion 53 is carried into the punch hole 721 of the first wall plate portion 72. As a result, the first and the second wall plate portions 72 and 73, and the first and the second upright strip portions 53 and 62 are fastened together.

Figure 16:
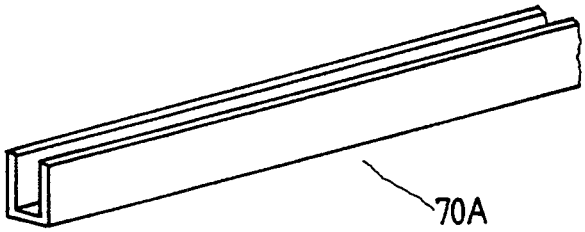
FIG. 16 shows a schematic view of a U-shaped member of a fifth preferred embodiment of the present invention.
Figure 17:
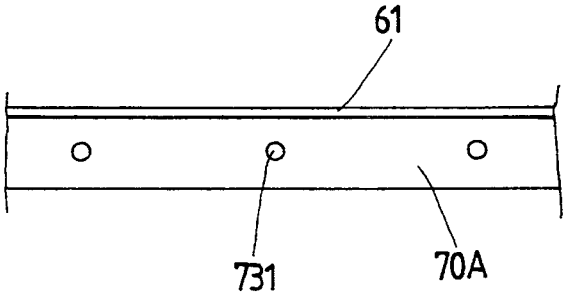
FIG. 17 is a right elevational view of the fifth preferred embodiment of the present invetion, showing that the U-shaped member of the fifth preferred embodiment of the present invention is installed.

As shown in FIGS. 16 and 17, the fifth preferred embodiment of the present invention is different from fourth preferred embodiment in that the former is provided with the U-shaped member 70A in place of a plurality of U-shaped members 70 of the fourth preferred embodiment of the present invention. With a plurality of punching tools 80, the punch holes can be made.

The fastening elements 100 and the nuts 200 used in the first and the third preferred embodiments may be replaced with rivets.

While the invention has been described in connection with what is presently considered to be the most practical and preferred embodiments, it is to be understood that the invention is not to be limited to the disclosed embodiments but on the contrary, is intended to cover various moditications and equivalent arranged included within the spirit and scope of the appended claims which scope is to be accorded the broadest interpretation so as to encompass all such modifications and equivalent structures.

What is claimed is:

1. An outer housing of a kitchen smoke exhauster comprising:

a left-right side plate having a main plate portion provided with a horizontal plate portion extending inwards from a top edge thereof, said horizontal plate portion having a first upright strip portion curving downwards from a side edge thereof;

a top plate having a base plate portion provided respectively at both left and right sides thereof with a second upright strip portion extending downwards in a curved manner, for being disposed side by side with said first upright strip portion of said left-right side plate; and a plurality of U-shaped members, each of which has horizontally a middle plate portion provided respectively at both left and right sides thereof with a first wall plate portion and a second wall plate portion, which extend upwards in a curved and corresponding manner, said U-shaped members being inserted upwardly such that said first and said second upright strip portions are held with an appropriate tightness in a middle slot of each of said U-shaped members, said second wall plate portion, said second upright strip portion, said first upright strip portion and said first wall plate portion being punched sequentially with a punching tool.

2. A outer housing of claim 1 wherein said plurality of U-shaped member may be replaced with a long U-shaped member of an appropriate length.

3. A outer housing of claim 1 wherein said first upright strip portion of said left-right side plate is provided at intervals with a plurality of first through holes; wherein said second upright strip portion of said top plate is provided with a plurality of second through holes corresponding in location and number to said first through holes of said first upright strip portion; wherein said first and said second wall plate portions of said plurality of U-shaped members are provided with a first air hole and a second through hole, which are corresponding in location and number to said first and said second through holes; and wherein said plurality of fastening elements are put sequentially through said second air hole, said second through hole, said first through hole and said first air hole, with each of said fastening elements being fastened with a nut.

4. A outer housing of claim 1 wherein said first upright strip portion of said left-right side plate is provided at intervals with a plurality of first through holes; wherein said second upright strip portion of said top plate is provided with second through holes corresponding in location and number to said first through holes of said first upright strip portion; wherein said plurality of U-shaped members are replaced with a long U-shaped member of a striplike construction and having a first and a second wall plate portions which are provided respectively with a plurality of spaced first air holes and spaced second air holes, with said first and said second air holes being corresponding in location to said first and said second through holes; and wherein said plurality of fastening elements are put sequentially under said top plate through said second air holes, said second through holes, said first through holes and said first air holes, with each of said fastening element being fastened with a nut.

5. A outer housing of claim 1 wherein said first upright strip portion of said left-right plate is provided with a plurality of spaced first through holes; wherein said second upright strip portion of said top plate is provided with a plurality of second through holes corresponding in location and number to said first through holes of said first upright strip portion; wherein said first and said second wall plate portions of said plurality of U-shaped members are provided with a plurality of first air holes and second air holes, which are corresponding in location to said first and said second through holes, with said first air holes being female threaded holes; and wherein said plurality of fastening elements are put under said top plate through said second air holes, said second through holes, said first through holes and said first air holes, said fastening elements being fastened with said first air holes which are female threaded holes.

6. A outer housing of claim 1 wherein said first upright strip portion of said left-right side plate is provided at intervals with a plurality of first through holes; wherein said second upright strip portion of said top plate is provided with a plurality of second through holes corresponding in location and number to said first through holes of said first upright strip portion; wherein said plurality of U-shaped members are replaced with a long U-shaped member of a striplike construction and having a first and a second wall plate portions, which are provided respectively with a plurality of spaced first air holes and spaced second air holes which are corresponding in location and number to said first and said second through holes, with said first air holes being female threaded holes; and wherein said plurality of fastening elements are put under said top plate through sequentially said second air holes, said second through holes, said first through holes, with said fastening elements being fastened at one end thereof with said first air holes being female threaded holes.

7. A outer housing of claim 3 wherein said fastening elements and said nuts are replaced with rivets.

8. A outer housing of claim 4 wherein said fastening elements and said nuts are replaced with rivets.

* * * * *